US009044792B1

(12) United States Patent
Rye et al.

(10) Patent No.: US 9,044,792 B1
(45) Date of Patent: Jun. 2, 2015

(54) CONDUIT DECONTAMINATION AND PRESSURE TESTING DEVICE

(76) Inventors: Seth Wrenne Rye, Erin, TN (US); Christopher Franklin Lambert, Lutts, TN (US); Kenneth Michael Sheppard, Clarksville, TN (US)

( * ) Notice: Subject to any disclaimer, the term of this patent is extended or adjusted under 35 U.S.C. 154(b) by 389 days.

(21) Appl. No.: 12/806,434

(22) Filed: Aug. 12, 2010

(51) Int. Cl.
*B08B 9/00* (2006.01)
*B08B 9/032* (2006.01)
*E03C 1/306* (2006.01)

(52) U.S. Cl.
CPC ..... *B08B 9/0321* (2013.01); *E03C 1/306* (2013.01)

(58) Field of Classification Search
None
See application file for complete search history.

(56) References Cited

U.S. PATENT DOCUMENTS

| | | | |
|---|---|---|---|
| 761,021 | A | 5/1904 | Venners |
| 5,445,945 | A | 8/1995 | Drechsler |
| 5,915,395 | A | 6/1999 | Smith |
| 6,627,089 | B1 | 9/2003 | Wilkinson |
| 7,145,976 | B2 | 12/2006 | Latreille et al. |
| 2005/0249631 | A1 | 11/2005 | Schulz et al. |

*Primary Examiner* — Eric Golightly
(74) *Attorney, Agent, or Firm* — Stephen J. Stark

(57) ABSTRACT

A conduit decontamination and pressure testing device with test module, fluid reservoir, decontaminant reservoir, decontaminant pump, Injection fluid reservoir, fluid injection pump, fluid exit tie-in, decontaminant neutralization device, and transport system.

15 Claims, 8 Drawing Sheets

CONDUIT DECONTAMINATION AND PRESSURE TESTING DEVICE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of conduit construction and more specifically a system and methods for conduit decontamination and pressure testing. In the art of liquid medium delivery systems, it is requisite that fluid main conduits be decontaminated and tested for leaks after installation or repair before being placed in service to end users. There are sundry known methods and systems for performing these tasks. However, there is no known device which comprises substantially all elements needed for said execution in one simple to use, compact unit and which easily affects communication of said elements with ancillary and peripheral devices.

Neither are there any configurations of said elements and ancillary devices which accomplish the required tasks with precision and/or effectiveness comparable to these taught herein. Nor is there any system or method which affects said tasks with ease and/or efficiency equal to these taught herein. In addition, the instant art, superior in all these respects, also comprises means for simple and easy transport, set up, and/or take-down, not seen in any extant conduit decontamination and pressure testing processes and devices.

The instant art is therefore a needed and desired advancement of the art.

BRIEF SUMMARY OF THE INVENTION

The primary object of the invention is to provide means for and facilitation of the decontamination and/or disinfection of conduits before first use or subsequent to repair.

Another object of the invention is to provide means for, and facilitation of, pressure testing of conduits before first use or subsequent to repair.

Another object of the invention is to provide means to automate all decontamination and disinfection functions.

A further object of the invention is to provide means for transport of device elements.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed Conduit decontamination and pressure testing device comprising a test module, fluid reservoir, decontaminant reservoir, decontaminant pump, injection fluid reservoir, fluid injection pump, fluid exit tie-in, and decontaminant neutralization device.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 1A is a view of an existing main conduit having a new main conduit tapped in.

LIST OF DESCRIBED ELEMENTS

Figure 1A:
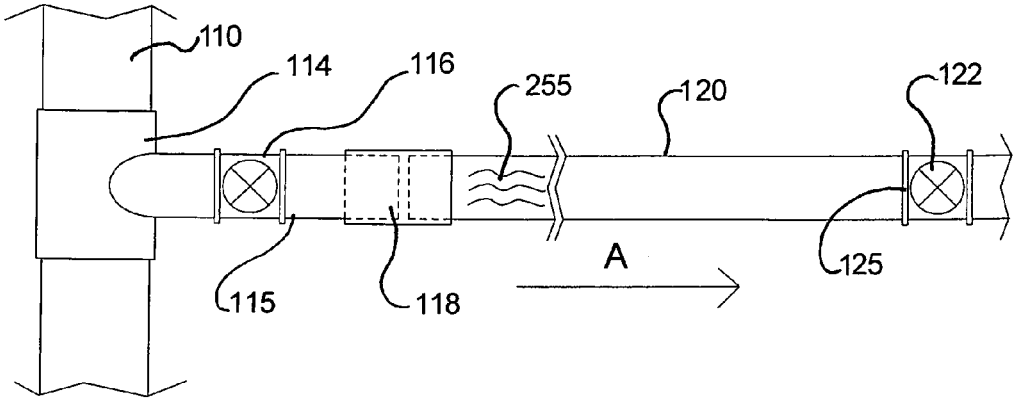

110 Existing main conduit
114 Tapping sleeve
115 Tap section
116 Upstream-control-valve
118 Mating sleeve
120 New main conduit
121 New main conduit section
122 Downstream-control-valve
123 Repaired section
125 New main conduit end
128 Reducer with mechanical joint
130 Test module front end section
132 Test module rear end section
134 Strainer
138 Fluid flow meter
140 Eductor
142 Back flow prevention apparatus
144 Isolation valve
148 Fluid injection tie-in A
150 Fluid injection tie-in B
152 Fluid injection conduit
154 Fluid injection volume meter
156 Fluid injection pump
160 Fluid reservoir
162 Fluid injection conduit valve
164 Decontaminant injection tie-in
166 Decontaminant
168 Decontaminant conduit
170 Decontaminant reservoir
174 Decontaminant injection pump
178 Decontaminant conduit valve
186 Decontaminant neutralization agent reservoir
190 Decontaminant neutralization agent pump or eductor
192 Decontaminant neutralization agent conduit valve
196 Decontaminant neutralization agent conduit
202 Pressure gauge

204 Fluid exit orifice
210 Test module
212 Fluid exit tie-in
214 Plug
216 Fluid exit regulation valve
220 Decontaminant neutralization agent
222 Decontaminant sensor
228 Test module removal valve
230 Conveyance means
234 Open or closed loop, remote or local control device
236 Central control unit
240 Main conduit section
242 Test module extension means
246 Fluid exit flow rate or pressure measuring device
248 Decontaminant neutralization tie-in
250 Storage device
252 Decontaminant neutralization agent/decontaminant sensor
254 Decontaminant neutralization agent flow measuring device
255 Fluid
Direction A

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

The instant art teaches a system and methods to decontamination of pipes or conduits of various sorts having fluid flow there through. It teaches installation, and communication, either permanently or temporarily, of such pipes or conduits with the herein taught apparatus. Means to interconnect devices such as valves, pipe or conduit sections, meters, gauges, and the like and the interface of different sized pipes or conduits to affect said communication either temporarily or permanently are well known in the art and will therefore not be described in meticulous detail. Further, said means of communication may be varied, therefore, the mention of any one in the description of any facet of the instant art is thus not intended to be limiting.

Also, though the instant art will be described in relation to potable water main conduits, it is not intended to be limited thereto but may be applied to conduits for virtually any fluid. In addition, though the instant art is described in relation to primary main conduits having smaller or secondary main conduits attached wherein the primary main conduit is generally pre-existing and the secondary main conduit is a new attachment thereto, the instant art is not intended to be limited to such configuration but could be used in relation to any conduit configuration.

Also, the term "upstream" shall mean nearer or toward the primary or existing main source or against the direction of flow in a main source, and the term "downstream" shall mean farther from or away from the primary or existing main source or with the direction of flow in a main source.

In the art of fluid distribution from provider to end user, it is normal practice to extend large, primary main conduits to or near a service area, and to connect smaller main conduits to the primary mains, smaller mains extending to particular concentrations of end users. In addition, as new areas requiring delivery are created, new primary main conduits may be connected to the primary existing main conduits.

FIG. 1A shows such a connection of an existing primary main conduit (110) with a new main conduit (120) wherein the connection is accomplished by means of a tapping sleeve (114) having a tap section (115) comprising upstream-control-valve (116). Proximal upstream-control-valve (116) is a mating sleeve (118) disposed such that upstream-control-valve (116) is between the tapping sleeve (114) and the mating sleeve (118). The mating sleeve (118) affects connection between the tap section (115) and the new main conduit (120). At a point extended from upstream-control-valve (116), the new main conduit (120) comprises downstream-control-valve (122) such that upstream-control-valve (116) is between downstream-control-valve (122) and tapping sleeve (114). Now, it may be readily appreciated that a fluid (255) may travel from the existing primary main conduit (110) through the new main conduit (120) in direction A, as indicated by arrow, that is, downstream from existing primary main conduit (110).

Thus, it may be readily appreciated that if upstream-control-valve (116) and downstream-control-valve (122) are open, fluid (255) may flow through the new main conduit (120) from the existing main conduit (110), that if upstream-control-valve (116) is open and downstream-control-valve (122) is closed, a portion of the new main conduit (120) may be filled with fluid (255). Further, if both upstream-control-valve (116) and downstream-control-valve (122) are closed, the new main conduit (120) may be isolated from the existing main conduit (110) and from any portion of new main conduit (120) downstream of downstream-control-valve (122). It may be readily appreciated that, thus isolated, the new main conduit may be tested or chemically treated without affecting the rest of the system.

Figure 1B:
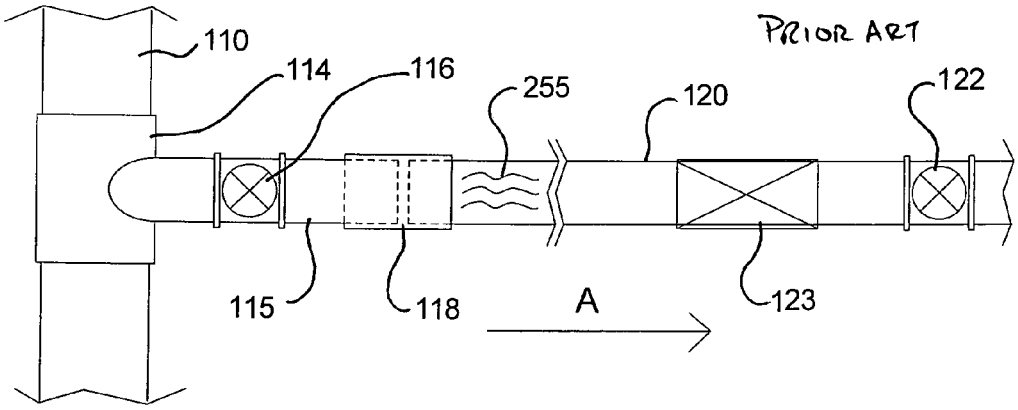
FIG. 1B is a view of an existing main conduit having a new main conduit tapped in which comprises a repaired section.

FIG. 1B shows a new main conduit (120) and existing main conduit (110) disposition comprising the same elements as depicted in FIG. 1A but wherein a compromised section of new main conduit (120) has been removed and replaced by repaired section (123).

Those familiar with the art will understand that prior to use for delivery of fluid to a consumer, any new main conduit (120), as one depicted in FIG. 1A and/or any previously existing main conduit (123) having been repaired, as one depicted in FIG. 1B, must be cleared of contaminants including but not limited to microbial agents, and also evaluated for integrity prior to use for delivery of fluid (255) to a consumer.

Figure 1C:
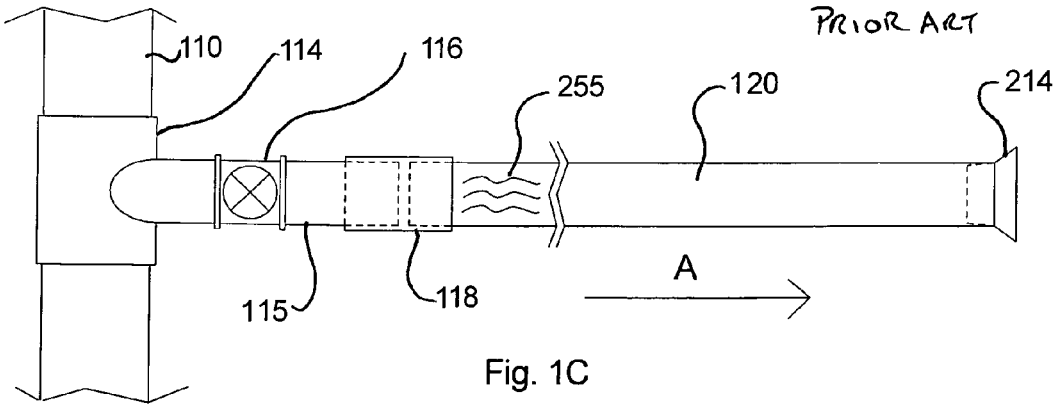
FIG. 1C is a view of an existing main conduit having a new main conduit tapped in which comprises a plug.

In most main conduit configurations, upstream-control-valve (116) and downstream-control-valve (122) will be installed as a matter of course. If they are not, valves or other elements to affect the same purpose may be temporarily installed in conjunction with exercise of the instant art. In addition, as depicted in FIG. 1C, the new main conduit end (125) may comprise a plug (214) or other stoppage means which, in lieu of a closed valve, will block the new main conduit (120) and thus enable exploitation of the instant art.

Figure 2:
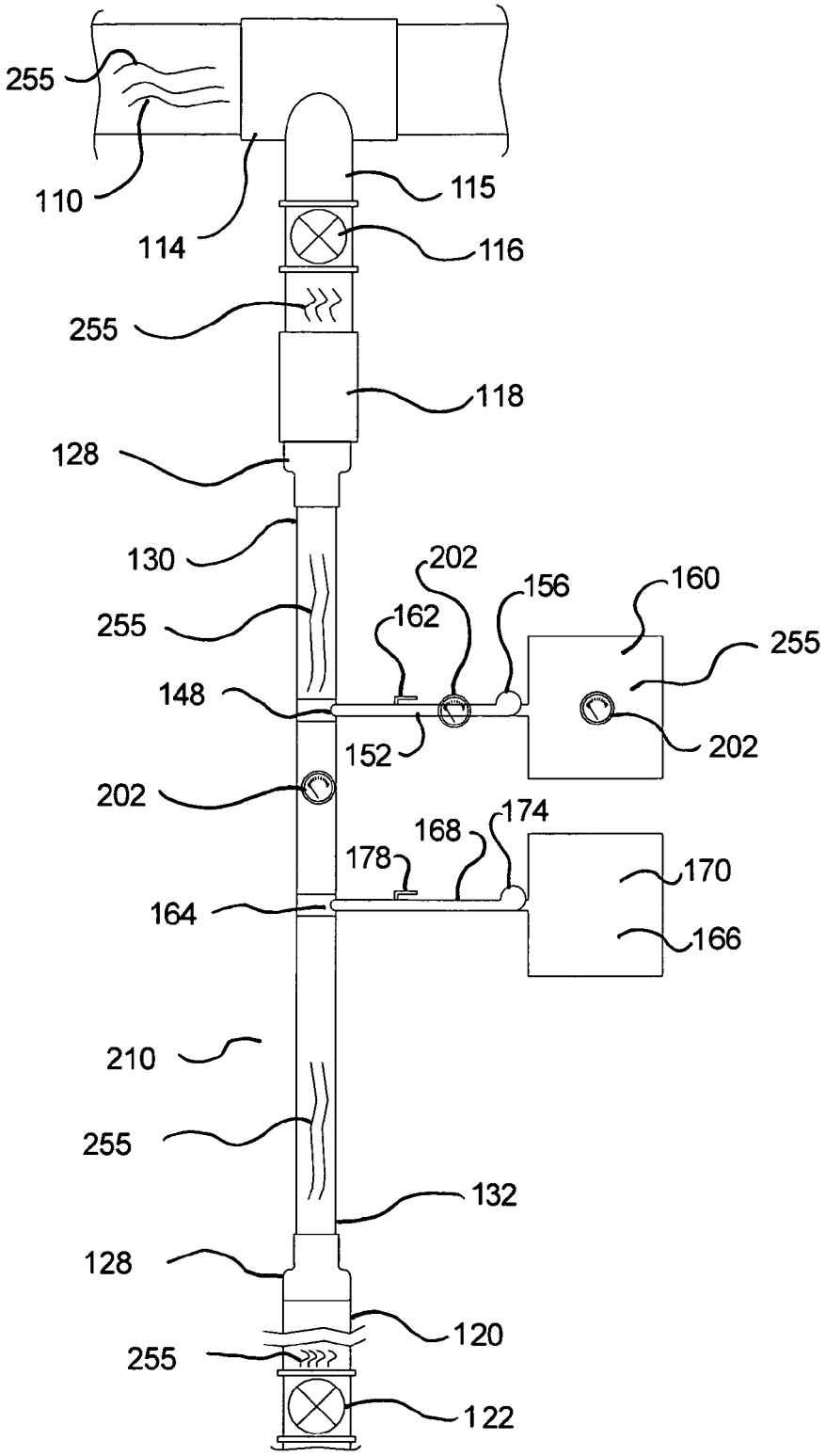
FIG. 2 is a view of a new main conduit having a test module inserted.

FIG. 2 shows the instant art comprising a test module (210) having a front end section (130), and a rear end section (132), the test module inserted within a section of a new main conduit (120) such that the test module front end section (130) is proximal the mating sleeve (118), tapping sleeve (114) and tap section (115). The rear end section (132) is distal the tapping sleeve (114). In such disposition, it is readily apparent that fluid (255) may flow from the existing main conduit (110) through the tap section (115), then through the test module (210) and into the new main conduit (120). Communicating with the test module (210), by means of a decontaminant conduit tie-in (164) is a decontaminant conduit (168) having a valve (178). The decontaminant conduit (168) also communicates with a decontaminant pump (174) which communicates with a decontaminant reservoir (170) containing any of sundry known decontaminants (166), in example a standardized 12% solution of NaOCl. The flow rate through the decontaminant conduit (168) may be adjusted by adjusting flow rate of the pump (174) and/or by adjusting the valve (178).

With respect to decontamination methods, it may be readily appreciated that by means of said arrangement, decontaminant (166) may be injected into the test module (210) where the agent (166) will be carried by the fluid (255) flowing there through as previously described. It will thence be borne through the new main conduit (120) whereupon the decontaminant (166) will contact and decontaminate the inner surface of the new main conduit (120).

It may also be understood that the decontamination process may be executed by various other methods. In example, the decontaminant solution may be caused to flow through the new main conduit (120) for a prescribed period of time. Alternatively, the new main conduit (120) may be filled with static decontaminant solution and isolated as previously described, so that said solution contacts the inner surfaces of the new main conduit for a prescribed period of time, thereby decontaminating it.

With respect to integrity testing provisions, means of pressurization are provided via an fluid injection conduit (152) communicating with the test module (210), by means of fluid injection tie-in A (148), said conduit (152) having a valve (162) and also communicating with an fluid injection pump (156) and an injection fluid reservoir (160). These components permit injection fluid (255) to be injected into the test module (210) to pressurize it and other elements communicating directly or indirectly with the test module (210), in example a new main conduit (120).

Of course, the flow rate through, or pressurization of, the fluid injection conduit (152) may be adjusted by adjusting flow rate of the pump (156) and/or adjustment of the valve (162). The injection fluid (255) stored in the injection fluid reservoir (160) and injected into the test module (210) may be the same as the fluid (255) conveyed by the existing main conduit (110) and the new main conduit (120), but is not thusly limited.

Now it may be readily apparent that by isolating the new main conduit (120), in example as previously described by manipulation of upstream-control-valve (116) and downstream-control-valve (122), plus opening the fluid injection conduit valve (162) permitting the isolated new main conduit (120) to communicate with the fluid injection pump (156), a pressure may be applied thereto by the pump (156). Also, the test module (210) may communicate with the tap section (115) and with the new main conduit (120) by means of reducers having mechanical joints (128).

One or more pressure gauges (202) may be disposed at convenient points between upstream-control-valve (116) and downstream-control-valve (122), in example at the test module (210), the fluid injection conduit (152) and/or the injection fluid reservoir (160), so that fluid pressure in the new main conduit (120) and elements communicating therewith may be ascertained. Also, art is well known by which pumps, suitable for exploitation in the instant art may comprise pressure measurement means.

Figure 3:
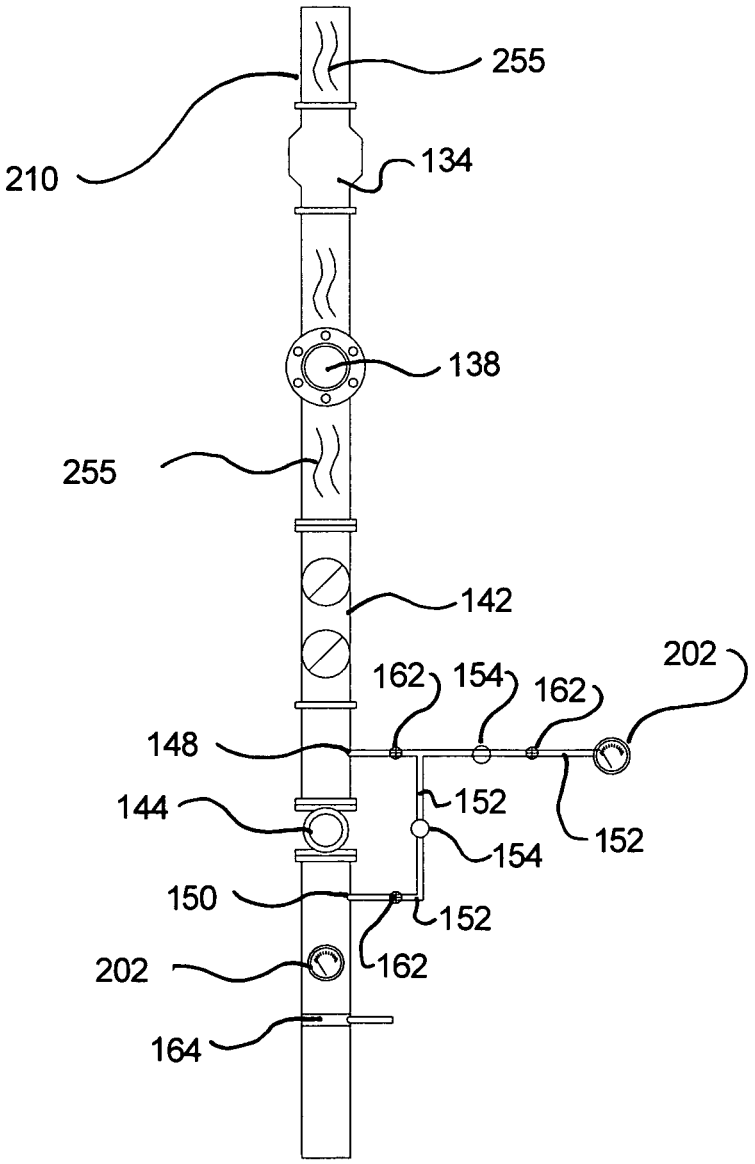
FIG. 3 is a view of a test module
Figure 4A:
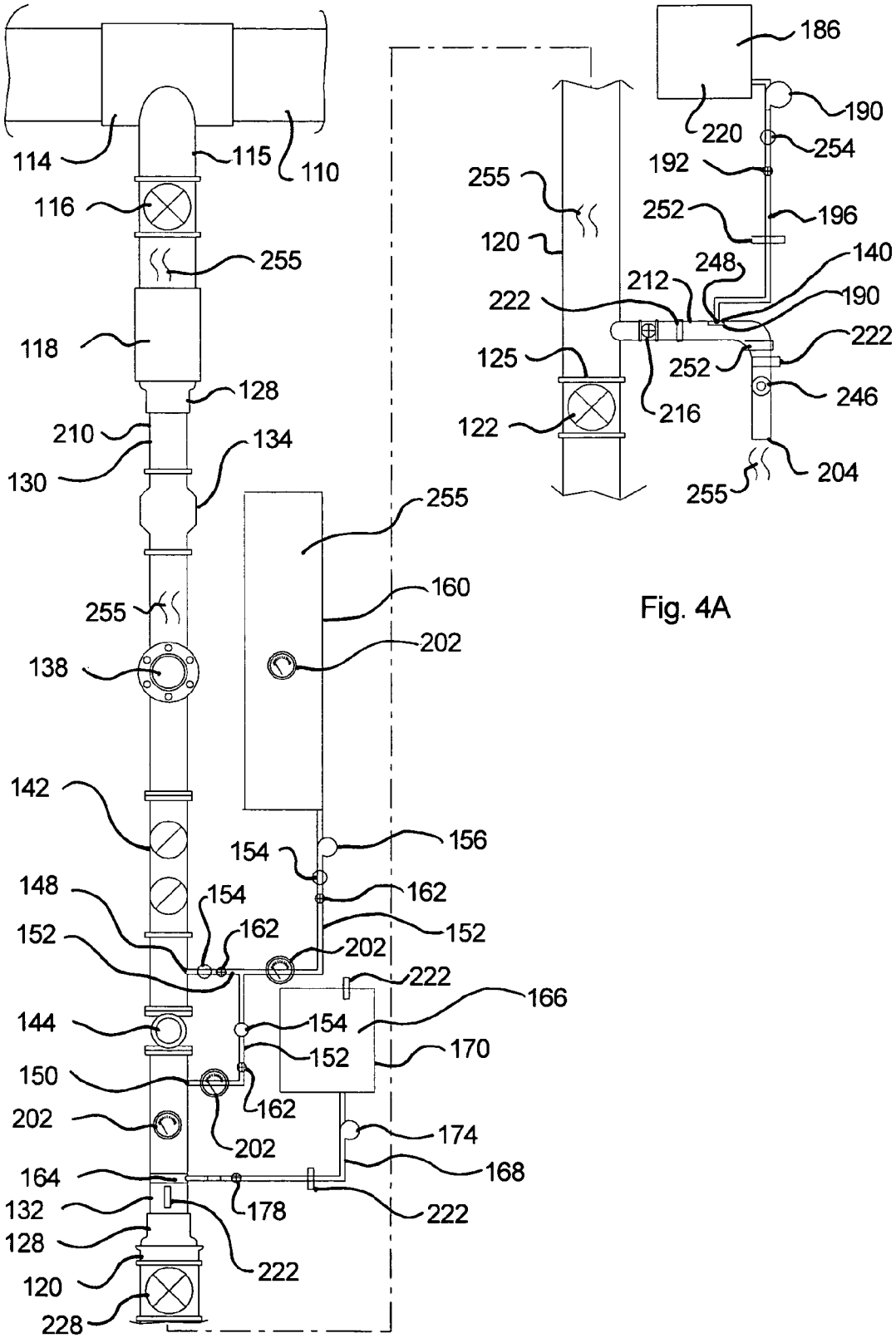
FIG. 4A is a view of a new main conduit having a test module inserted and a fluid exit tie-in attached with decontaminant neutralization means.

FIG. 3 and FIG. 4A show the test module (210) which comprises a strainer (134) through which a fluid (255) entering the test module (210) must pass, a meter (138) that measures the flow rate through the test module (210), an isolation valve (144), and a backflow prevention apparatus (142) that prevents fluid (255) in the new main conduit (120) and test module (210) from flowing upstream into the existing main conduit (110). A fluid injection conduit (152) communicates with the injection fluid reservoir (160) and is contrived to communicate with the test module (210) both upstream and downstream of isolation valve (144), in example, injection conduit (152) may be bifurcated by manipulation of appropriate valve(s) in such a way as to permit said conduit (152) to communicate with the test module (210) upstream of valve (144) at fluid injection tie-in A (148) and/or downstream of valve (144) at fluid injection tie-in B (150).

Further, the conduit may comprise one or more fluid injection conduit valves (162) which may be disposed to be manipulated to allow fluid (255) to be injected both upstream and downstream, only upstream, or only downstream, of the isolation valve (144). Shown as well is the decontaminant conduit (168) having the valve (178), and communicating with the decontaminant pump (174) which, in turn, communicates with the decontaminant reservoir (170). Of course, the flow rate through the decontaminant conduit (168) may be adjusted by adjusting flow rate of the pump (174) and/or adjusting the valve (178).

The fluid injection conduit (152) may be removably connected to the fluid injection tie-in A (148) and/or to the fluid injection tie-in B. The decontaminant conduit may be removably connected to the decontaminant injection tie-in (164). The fluid injection conduit (152) and on decontaminant conduit (168) may include removable sections that may be rigid or flexible.

FIG. 4A shows the test module (210) in operative position with the test module front end section (130) and the test module rear end section (132) communicating with a to-be-tested new main conduit (120) proximal the mating sleeve (118) and to the tap section (115). Said communication depicted by FIG. 4A is by means of reducers (128) with mechanical joints. However, those familiar with the art will readily appreciate that there are other well known means which may be substituted. In addition, while the test module (210) in FIG. 4A is smaller in diameter than the new main conduit (110), this difference in diameter has no adverse effects on functionality of the test module (210).

For the decontamination process of a new main conduit (120) to be best accomplished, means should be provided for fluid (255) to exit the new main conduit (120) as closely as possible to its distal end (125). Thus, FIG. 4A shows a fluid exit tie-in (212) having a fluid exit orifice (204) so that fluid (255) may leave the new main conduit (120) through the fluid exit tie-in (212) while being expelled through the fluid exit orifice (204). Shown as well is a fluid exit regulation valve (216) so that flow out of the new main conduit (120) may be adjusted from zero to maximum.

In addition, flow rate of fluid (255) from a conduit, in example the fluid exit tie-in (212), may be influenced by the diameter of the exit, in example fluid exit orifice (204) and the fluid pressure proximal the exit. Therefore the fluid exit tie-in (212) may comprise a fluid exit flow rate or pressure measuring device (246) proximal the fluid exit orifice (204). Said flow rate data thusly obtained may be used in addition to or in place of flow rate data otherwise obtained as previously taught, herein.

Also, since the fluid (255) exiting will comprise decontaminant (166), it is desirable, if not required by law, to neutralize said decontaminant (166) before it is discharged into the environment. Thus the fluid exit tie-in (212) may comprise any of sundry decontaminant neutralization means. As depicted in FIG. 4A, said means comprise a decontaminant neutralization agent (220), in example sodium thiosulfate stored in a reservoir (186) that communicates by conduit (196) with the fluid exit tie-in (212) at the decontaminant neutralization agent tie-in (248). Said conduit (196) comprises a pump (190) or eductor (140) to urge decontaminant neutralization agent (220) from the reservoir (186) to the fluid exit tie-in (212) where it will combine with fluid (255) in the fluid exit tie-in (212) and react with the decontaminant (166). If the above is accomplished by means of an eductor (140), the eductor is preferably located at the fluid exit tie-in (212) and in communication with the decontaminant neutralization agent conduit (196) at the tie-in (248), such that fluid passing through the fluid exit tie-in (212) will entrain decontaminant neutralization agent (220), thusly drawing it into the tie-in (212), to mix with the fluids carrying decontaminant (166).

The decontaminant neutralization agent conduit (196) may also comprise a valve (192) which may be used to regulate the flow of decontaminant neutralization agent (220) and a meter (254) to measure the flow rate of decontaminant neutralization agent (220) through said conduit (196). The flow rate of decontaminant neutralization agent (220) entering the fluid exit tie-in (212) may thus be regulated by valve (192) and/or by variance of the pump (190) flow rate.

In many circumstances, it may be advantageous or desirable to affect a particular concentration of decontaminant (168) in the fluid flowing from the test module (210) into the new main conduit (120). Thus, the test module (210) may comprise the fluid flow meter (138), here depicted in FIG. 4A as upstream of the decontaminant injection tie-in (164). But, not thusly limited, the flow meter may be located in any convenient point accessible to the fluid flow. Thereby, the fluid flow rate and the volume traveling through the test module and into and through the new main conduit (120) may be determined.

From these data, the amount of decontaminant (166) which must be injected into the flow to produce the required concentration may easily be calculated. In addition, the amount of decontaminant (166) injected may be controlled by adjusting the flow rate of the pump (174) and/or by adjusting one, any, or all of decontaminant conduit valves (178).

The decontaminant reservoir (170), decontaminant conduit (168), among other elements of the instant art may comprise sensors (222) to determine or verify the decontaminant concentration achieved.

To monitor or affect automated control of the concentration of decontaminant (166), one or a plurality of decontaminant sensors (222) may be situated at any convenient point or points along the test module (210) and/or along new main conduit (120), or fluid exit tie-in (212). If data from same indicate variance from desired concentration, said concentration may then be adjusted manually as previously taught or automatically, using a system that responds to concentration levels detected.

To use the device, the test module (210) is first placed in operative position, for conduit decontamination. An upstream-control-valve (116) is opened allowing fluid (255) to flow into the test module (210) whereupon said fluid (255) may then pass through strainer (134) to remove undesirable materials and to be metered for flow rate and/or volume. Referring to the flow rate, the amount of decontaminant (166) necessary to produce the required concentration may be calculated, and the injection of decontaminant (166) into test module (210) may proceed.

The fluid (255) thusly charged with decontaminant (166), then travels through the new main conduit (120) to the new main conduit end (125), the point beyond which no decontamination is required, and as it does so, it contacts and decontaminates the inner surface of the new main conduit (120). As previously taught, this end point may comprise downstream-control-valve (122), a plug (214), or other known means limiting the new main conduit (120) and/or blocking further passage of any fluid. When fluid (255) with decontaminant (166) reaches the new main conduit end (125), it is allowed to exit through the fluid exit tie-in (212) disposed proximal the new main conduit end (125).

The new main conduit end (125) and/or the fluid exit tie-in (212) may comprise one or more of decontaminant sensors (252) so that when decontaminant (166) is detected in the fluid (255) at the new main conduit end (125), decontaminant concentration may be measured and decontaminant neutralization activated. The amount, and rate of injection, of decontaminant neutralizing agent (220) required may be determined according to the concentration of decontaminant (166) present at the new main conduit end (125), and/or ejected through the outlet of the fluid exit tie-in (212) as sensed by the one or more decontaminant neutralization agent/decontaminant sensors (252).

Downstream of decontaminant neutralization tie-in (248), the fluid exit tie-in (212) may comprise one or more sensors (252) to detect presence of decontaminant (166) and/or decontaminant neutralization agent (220). Thusly, it may be verified that discharged fluid has been sufficiently neutralized, and if not, then injection of decontaminant neutralizing agent (220) may be adjusted accordingly. Likewise, if excess decontaminant neutralization agent (220) is detected, flow of same may be appropriately reduced. Thus, expulsion of active decontaminant (168) and/or neutralization agent (220) into the environment is avoided.

The fluid exit tie-in (212) may further comprise a fluid exit regulation valve (216) which may completely block the discharge of fluid or may be used to adjust the volume of fluid discharged.

When the decontamination process is complete, injection of decontaminant (166) is stopped. Then, when fluid exiting the new main conduit end (125) is determined to be free of decontaminant, decontaminant neutralization may be ceased.

To pressure test the new main conduit (120) for leaks, the fluid exit regulation valve (216) is closed, or alternately the fluid exit tie-in (212) may be closed off, so that the new main conduit end (125) is sealed. An upstream-control-valve (116) is closed, blocking flow into the test module (210) and to the new main conduit (120), leaving both substantially full, and isolated such that they comprise a pressure vessel.

Subsequently, one or more of fluid injection conduit valves (162) are opened allowing fluid to be injected into the new main conduit (120) by the fluid injection pump (156) from the fluid reservoir (160). The pump (156) is activated; injecting fluid into the new main conduit (120), filling any voids therein, and pressure is built up in the new main conduit (120) to a pre-determined level, which pressure may be ascertained by one or more pressure gauges (202) on any of the pressurized elements, especially the pump (156).

Pressure in the new main conduit (120) may be monitored and its integrity ascertained, by its ability to retain pressure over time. If pressure cannot be maintained and leaks occur, the new main conduit (120) may be re-pressurized via the fluid injection pump (156) and the volume of fluid required to refill said new main conduit, measured. In example, the fluid injection conduit (152), or other element situated between the new main conduit (120) and the injection fluid reservoir (160), may comprise one or more fluid injection volume meters (154) that measure volume of fluid transferred from the injection fluid reservoir (160) during re-pressurization.

These data may then be used to calculate leakage percentages, or leakage rates, or pressure loss and rates thereof, which in turn may be compared to pre-determined standards to determine integrity of the new main conduit. The new main conduit (120), if satisfactory, may then be opened for use. If not satisfactory, then remedial measures may be taken.

FIG. 4A shows additionally that the test module (210) may comprise an isolation valve (144) which when closed, will isolate a substantial portion of the test module (210) from the new main conduit. Also seen is that the fluid injection conduit (152) may be contrived so that fluid may be injected either upstream or downstream of the isolation valve (144) or both by manipulation of one or more fluid injection conduit valves (162).

Particularly shown is that, in this case, the fluid injection conduit (152) is bifurcated with one branch communicating with the new main conduit (120) at fluid injection tie-in A (148), upstream of valve (144), and fluid injection tie-in B (150) downstream of valve (144). Now, we may readily appreciate that said upstream and/or downstream fluid injection may be achieved by other arrangements of conduits, pumps, reservoirs, or valves thus the depiction of FIG. 4A is not intended to be limiting.

Figure 4B:
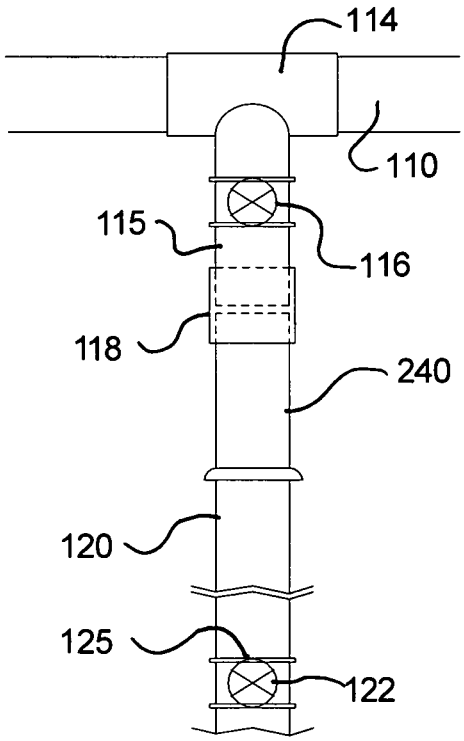
FIG. 4B is a view of a decontaminated and pressure tested new main conduit.

Subsequent to completion of decontamination and pressure testing, the test module (210) is removed and replaced by a fluid main conduit section (240) compatible with the new main conduit (120), as shown in FIG. 4B. FIG. 4A additionally shows that a test module removal valve (228) may be placed in the new main conduit (120) proximal the test module rear end section (132). Said valve (228) may be closed prior to test module (210) removal so that fluid in the new main conduit (120) downstream of said valve (228) might not flow out of new main conduit (120) before void left by removal of test module (210) is replaced by new main conduit test module replacement section (240) installation. After the test module (210) is removed, and new main conduit section (240) added, the test module removal valve (228) may be removed or it may remain in place, and open on a substantially permanent basis.

As described, the decontamination and pressure testing of new or repaired main conduits by the instant art requires a flow of fluid through the test module (210) and the new or repaired main conduit (120) and out through the fluid exit orifice (204) of the fluid exit tie-in (212). As described, the source of said fluid flow is the existing main conduit (110) which communicates with the new main conduit (120) and which is regulated by upstream-control-valve (116). However, it may be readily appreciated that fluid in the new main conduit (120) may be drawn from other sources. In example, the fluid might be drawn from a tank truck, or from a hydrant on an existing main conduit (110). Also, while the instant art has been described in relation to a new main conduit (120), it may be understood that the instant art may serve equally well in repairing or disinfecting section (123), if said repaired section is between the test module (210) and the new main conduit end (125).

Figure 5:
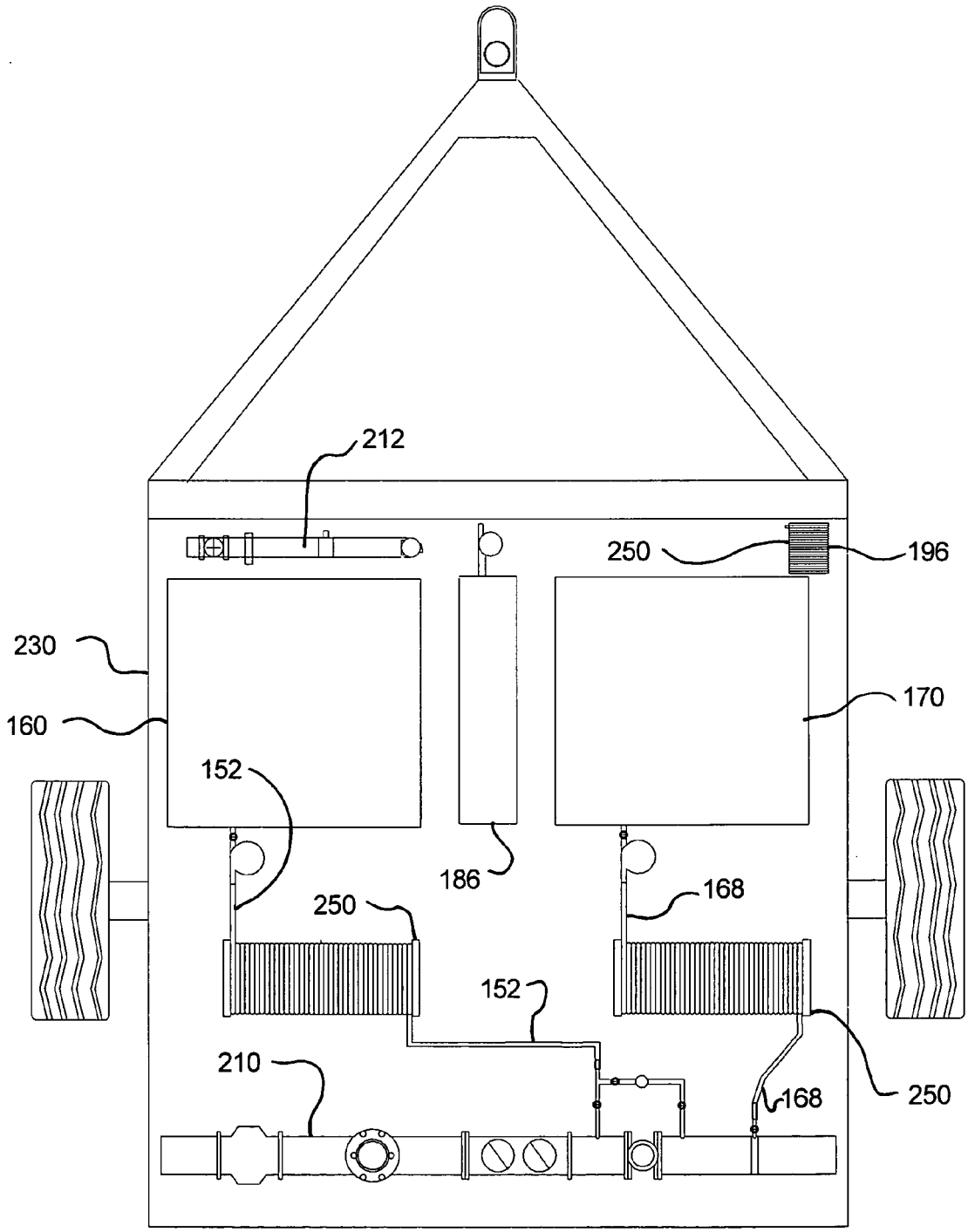
FIG. 5 is a view of the instant art comprising transport means.

FIG. 5 shows that the test module (210) and all other elements required to decontaminate and/or pressure test a conduit section, including reservoirs, conduits, meters, sensors, pumps, etc. may be conveniently mounted on a conveyance device, a trailer (230), that is specifically configured to this purpose. So mounted, they can be easily transported from place to place, dismounted, employed, and returned to said conveyance device for re-transport with relative ease and efficiency.

Alternatively, by means of shunts or hosepipe easily carried, the various elements may be fully and efficiently exploited while remaining mounted on the transport trailer. FIG. 5 additionally shows various conduits of sufficient length and/or flexibility so mounted that reservoirs (160) (170) (186) on the conveyance device (230) can be used without being removed from their mounted positions. Further, the fluid injection conduit (152), the decontaminant conduit (168), and/or decontaminant neutralizing agent conduit (196) may comprise one more or flexible segments which may be wound about a storage device (250), in example a reel, when not in use, or paid out when deployed.

Figure 6:
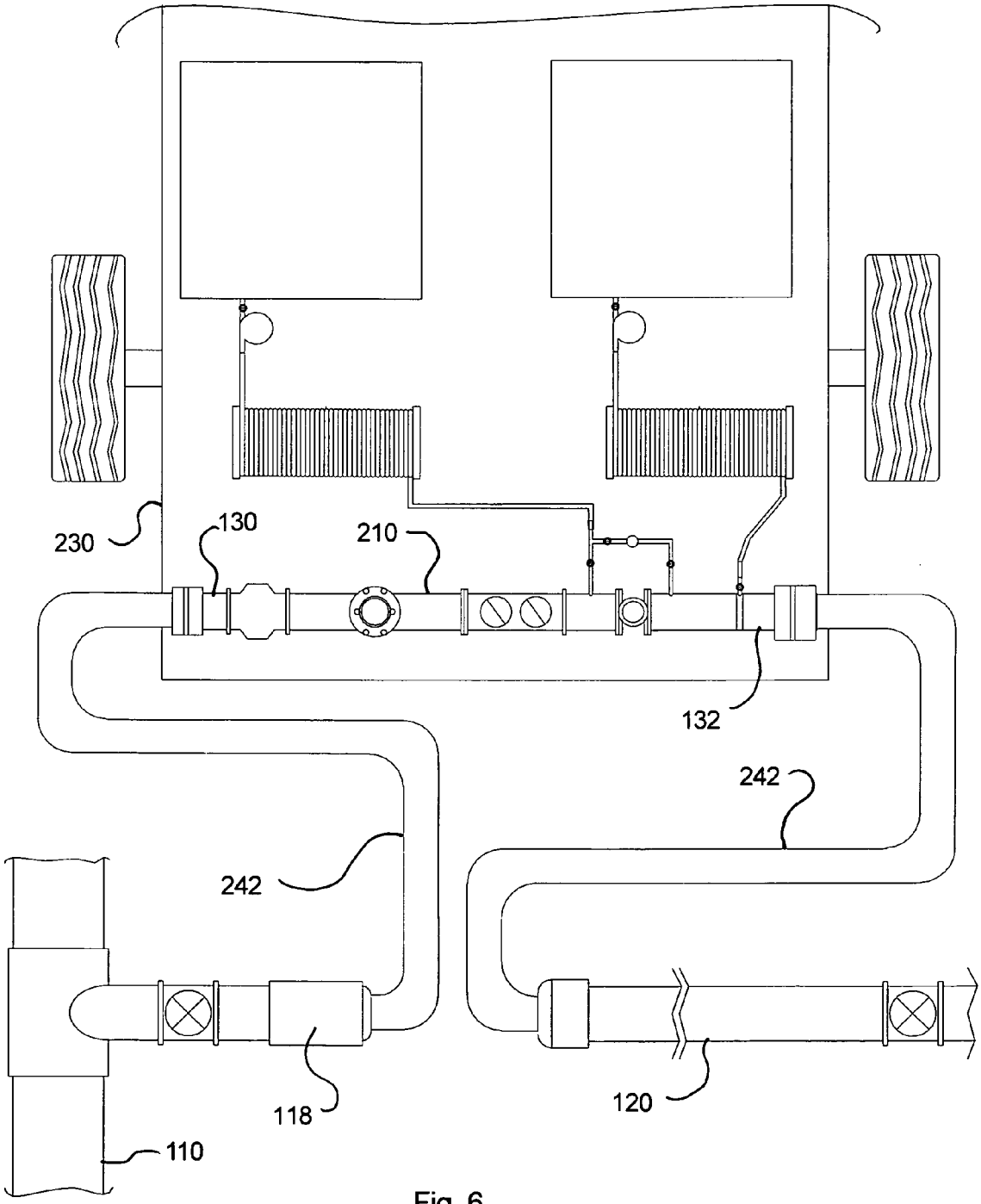
FIG. 6 is a view of the instant art configured for use wherein the test module remains mounted aboard the transport means.

FIG. 6 shows that the test module (210) may communicate with the new main conduit (120) via an additional conduit-test-module extension means (242), in this example, hoses, attached to new main conduit (120) at the mating sleeve (118) and the test module front end section (130) and the test module rear end section (132) and the new main conduit (120) downstream from the mating sleeve and the test module (210). Therefore, it may be readily appreciated that the test module (210) may be employed in decontamination and pressure test procedures without being removed from the conveyance device (230).

Figure 7:
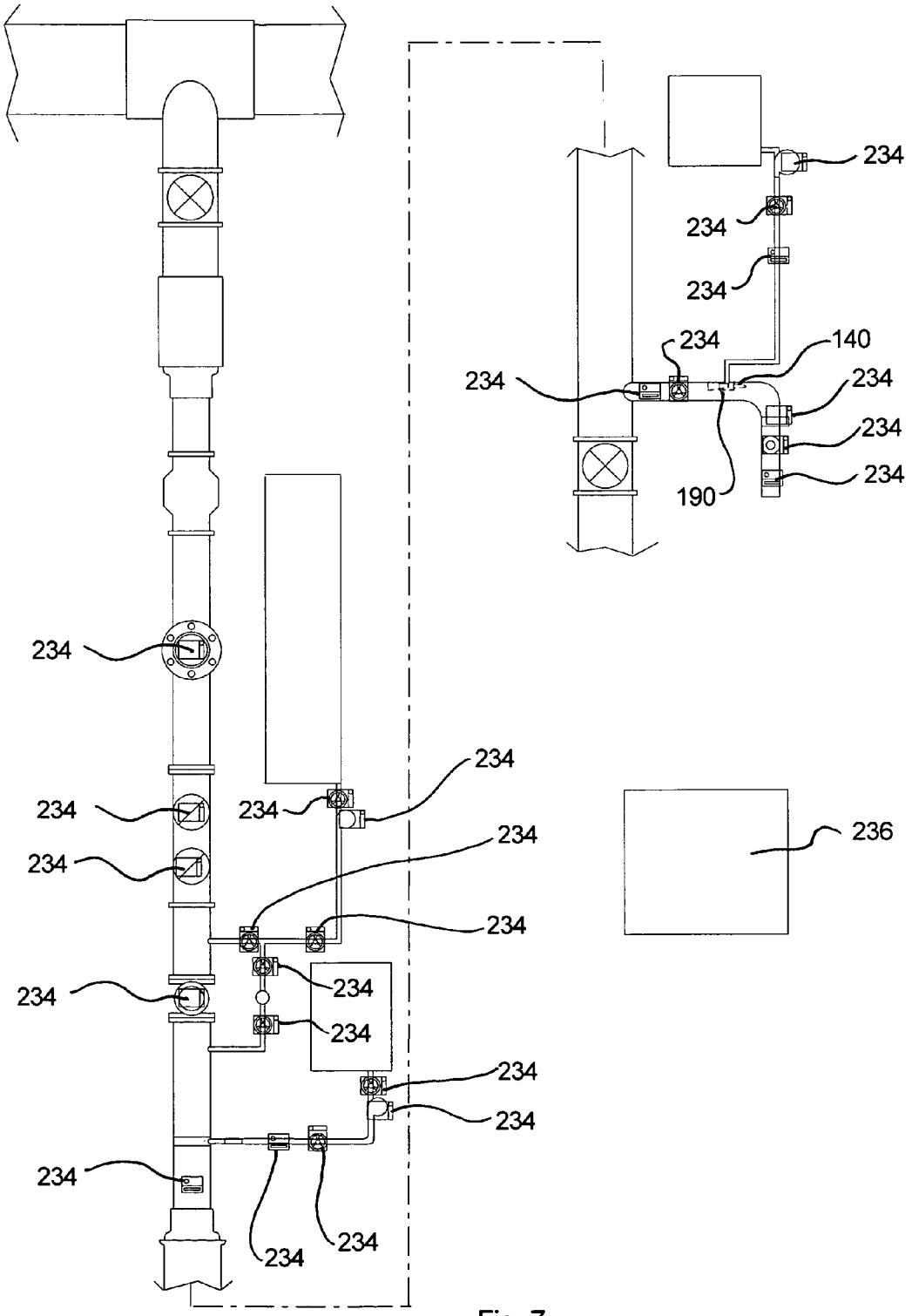
FIG. 7 is a view of the instant art configured for remote and/or automatic operation.

FIG. 7 shows that all pumps, valves, sensors, and/or gauges comprising the instant art may communicate with open or closed loop, remote or local control devices (234), having data reception and or transmission capabilities. They may transmit data to and receive signals from a central control unit (236) which is either manually operated, or is controlled by one or more computer processors. In manual mode, the central control unit (236) can display, receive, or otherwise communicate, data to or from a human operator, and to receive and transmit commands from said operator to various elements of the instant art. This includes provision for the instant art to be operated manually from a remote location.

In automated mode, the central control unit (236) receives data from sensors and/or gauges, processes the data, and responds by sending commands to appropriate open or closed loop, remote or local control devices (234) to adjust their associated elements as necessary to bring conditions into conformity with relevant parameters. In example, if sensors indicate that the decontaminant (166) concentration at the fluid exit tie-in (212) is too low, the central control unit (236) may command the open or closed loop, remote or local control device (234) controlling the decontaminant injection pump (174) and/or one or more decontaminant conduit valves (178) to increase flow of said decontaminant (166) into test module (210) and/or the new main conduit (120).

Thus, the central control unit may operate fully or partially automatically with little or no monitoring and/or control inputs by a human operator.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

The invention claimed is:

1. A conduit preparation module in, combination with a channel and a conduit-in-preparation;

said conduit preparation module so configured that said channel is placed in direct or indirect fluid-flow communication with the conduit-in-preparation, and in direct or, alternately or concurrently, indirect fluid-flow communication with a fluid source, such that fluid from said fluid source flows from said fluid source through the conduit preparation module and then flows into said conduit-in-preparation, said conduit preparation module comprising a decontaminant conduit placed in fluid-flow communication, directly, or, alternately or concurrently, indirectly, with the conduit-in-preparation, said decontaminant conduit also placed in fluid-flow communication, directly or alternately or concurrently, indirectly, with a decontaminant fluid pump, said decontaminant fluid pump is placed in communication directly, or alternately or concurrently, indirectly, with a liquid decontaminant source, said decontamination conduit also comprising a decontaminant conduit valve, wherein fluid flow rate through the decontaminant conduit is adjusted by adjusting the flow rate of the decontaminant pump, or alternatively or concurrently, by adjusting said decontaminant conduit valve, whereby, the liquid decontaminant is at least selectively injected into the conduit preparation module directly using the liquid the decontaminant pump to inject the decontaminant, wherein decontaminant, when injected, is combined with fluid flowing there through, and from which it can be borne to the conduit-in-preparation, whereupon into or through which the decontaminant can then flow, during which flow, the decontaminant comes in contact with an inner surface of the conduit-in-preparation, and said liquid decontaminant with the decontaminant pump is utilized at least in part from the liquid decontaminant source to pressure test at least the conduit-in-preparation; and also incorporating means of neutralizing injected decontaminant after it has been used, and before it is discharged for disposal, said means comprising a neutralizer source and a decontaminant neutralizer mixing and ejection device, wherein decontaminant neutralizer can be cached in the neutralizer source, said neutralizer source being in communication with the decontaminant neutralizer mixing and ejection device whereby decontaminant and decontaminant neutralizing agent is mixed and ejected for disposal, wherein the decontaminant conduit also comprises a decontaminant neutralizer conduit valve which is used to regulate the flow of decontaminant neutralizer, and a sensor and display that extracts and displays information by which flow rate of decontaminant neutralizer through said decontaminant conduit may be measured.

2. A conduit preparation module as in claim 1 also comprising a meter that measures the flow rate through the conduit preparation module of liquid passing through and into the conduit in preparation from the conduit preparation module.

3. A conduit preparation module as in claim 1 wherein, a fluid injection conduit can be placed in direct or indirect fluid-flow communications with the, said fluid injection conduit having a fluid-injection valve by which fluid flow through the fluid injection conduit can be controlled, and said fluid injection conduit being also in communication with a fluid injection pump, said pump in communication with an injection fluid source from which the pump can inject fluid into the conduit preparation module, through said conduit-preparation-module which said fluid flows to elements that are in communication with the conduit preparation module, these elements comprising a conduit-in-preparation, and wherein fluid flow rate through the fluid injection conduit is adjusted by adjusting the flow rate of the fluid-injection-pump and, alternatively or concurrently, by adjusting the fluid-injection-valve, also comprising a backflow prevention apparatus upstream of the conduit in preparation, the fluid injection conduit, and the decontaminant conduit, so configured as to prevent fluid in the conduit-in-preparation or conduit preparation module from flowing upstream.

4. A conduit preparation module as in claim 1 also comprising a strainer through which fluid entering the conduit preparation module must pass, also comprising a meter that can measure the flow rate through the conduit preparation module, wherein, a fluid injection conduit is placed in direct or indirect fluid-flow communications with the conduit preparation module, said fluid injection conduit having a fluid-injection valve by which fluid flow through the fluid injection conduit is controlled, and said fluid injection conduit being also in communication with a fluid injection pump, said pump in communication with a injection fluid source from which the pump injects fluid into the conduit preparation module, through said conduit preparation module which said fluid flows to elements that are in communication with the conduit preparation module, these elements comprising a conduit-in-preparation, and wherein fluid flow rate through the fluid injection conduit is adjusted by adjusting the flow rate of the fluid-injection-pump and, alternatively or concurrently, by adjusting the fluid-injection-valve, also comprising a backflow prevention apparatus so configured as to prevent fluid in the conduit-in-preparation or conduit preparation module from flowing upstream.

5. A conduit preparation module as in claim 1 wherein, a fluid injection conduit is placed in direct or indirect fluid-flow communications with the conduit preparation module, said fluid injection conduit having a fluid-injection valve by which fluid flow through the fluid injection conduit is controlled, and said fluid injection conduit being also in communication with a fluid injection pump, said pump in communication with a injection fluid source form which the pump injects fluid into the conduit preparation module, through said conduit preparation module which said fluid flows to elements that are in communication with the conduit preparation module, these elements comprising, a conduit-in-preparation, and wherein fluid flow rate through the fluid injection conduit is adjusted by adjusting the flow rate of the fluid-injection-pump and, alternatively or concurrently, by adjusting the fluid-injection-valve, wherein the fluid injection conduit is in communication with the injection fluid source and also in communication with the conduit preparation module at at least one valve located upstream and at least one valve located downstream of an isolation valve, such that said fluid injection conduit communicates with the conduit preparation module upstream of the isolated valve, and downstream of the isolated valve.

6. A conduit preparation module as in claim 1 wherein, a fluid injection conduit is placed in direct or indirect fluid-flow communications with the conduit preparation module, said fluid injection conduit having a fluid-injection valve by which fluid flow through the fluid injection conduit is controlled, and said fluid injection conduit being also in communication with a fluid injection pump, said pump in communication with a injection fluid source from which the pump injects fluid into the conduit preparation module, through said conduit preparation module which said fluid flows to elements that are in communication with the conduit preparation module, these elements comprising a conduit-in-preparation, and wherein fluid flow rate through the fluid injection conduit is adjusted by adjusting the flow rate of the fluid-injection-pump and, alternatively or concurrently, by adjusting the fluid-injection-valve, wherein the fluid injection conduit also comprises one or more fluid injection conduit valves so disposed as to be manipulable to allow fluid injection both upstream and downstream of an isolation valve, only upstream of the isolation valve, or only downstream of the isolation valve.

7. A conduit preparation module as in claim 1 also comprising a strainer through which fluid entering the conduit preparation module must pass.

8. A conduit preparation module as in claim 1, also having capability of monitoring concentration of decontaminant, in the decontaminant source, decontaminant conduit, or any other element of the instant art, comprising one or more decontaminant sensors situated at one or more points of the decontaminant source, the decontamination conduit, the conduit preparation module, a main conduit, or a decontaminant neutralizer mixing and ejection device.

9. A conduit preparation module as in claim 1 wherein ease and efficiency are improved in using the conduit preparation module and all other elements required to decontaminate and/or pressure test a conduit section, by arranging them on a conveyance device, in such a way that they might be transported from place to place, put in use, removed from operative position, and put back on said conveyance device for re-transport with at least some elements remaining on the conveyance device during use.

10. A conduit preparation module as in claim 9 wherein, one or more of a fluid injection conduit, the decontaminant conduit or decontaminant neutralizing agent conduit compromise one or more flexible segments which are wound about a containment device, when not disposed in operative position, and are unrolled and extended for use.

11. A conduit preparation module as in claim 1 wherein the conduit preparation module is supported at least in part by a conveyance device and the conduit preparation module may communicate with the decontaminant conduit by an extension, such that the conduit preparation module may be employed in decontamination and pressure conduit preparation procedures without the conduit preparation module being removed from a conveyance device.

12. A conduit preparation module in, combination with a channel and a conduit in preparation;

said conduit preparation module so configured that said channel is placed in direct or indirect fluid-flow communication with the conduit-in-preparation, and in direct or, alternately or concurrently, indirect fluid-flow communication with a fluid source, such that fluid from said fluid source flows from said fluid source through the conduit preparation module and then flows into said conduit-in-preparation, said conduit preparation module comprising a decontaminant conduit placed in fluid-flow communication, directly, or, alternately or concurrently, indirectly, with the conduit-in-preparation, said decontaminant conduit also placed in fluid-flow communication, directly or alternately or concurrently, indirectly, with a decontaminant fluid pump, said decontaminant fluid pump is placed in communication directly, or alternately or concurrently, indirectly, with a liquid decontaminant source, said decontamination conduit also comprising a decontaminant conduit valve, wherein fluid flow rate through the decontaminant conduit is adjusted by adjusting the flow rate of the decontaminant pump, or alternatively or concurrently, by adjusting said decontaminant conduit valve, whereby, the liquid decontaminant is at least selectively injected into the conduit preparation module directly using the liquid the decontaminant pump to inject the decontaminant, wherein decontaminant, when injected, is combined with fluid flowing there through, and from which it can be borne to the conduit-in-preparation, whereupon into or through which the decontaminant can then flow, during which flow, the decontaminant comes in contact with an inner surface of the conduit-in-preparation, and said liquid decontaminant with the decontaminant pump is utilized at least in part from the liquid decontaminant source to pressure test at least the conduit-in-preparation; and also incorporating means of neutralizing injected decontaminant after it has been used, and before it is discharged for disposal, said means comprising a neutralizer source and a decontaminant neutralizer mixing and ejection device, wherein decontaminant neutralizer is cached in the neutralizer source, said neutralizer source being in communication with the decontaminant neutralizer mixing and ejection device whereby decontaminant and decontaminant neutralizing agent is first mixed and then ejected for disposal, wherein said communication is by means of a neutralizer conduit and comprises a neutralizer-pump whereby decontaminant neutralizer is urged from the neutralizer source through the neutralizer conduit to the decontaminant neutralizer mixing and ejection device, also comprising flow-rate controls for the neutralizer-pump whereby rate at which the pump transfers fluid is regulated, and a sensor and display that can extract and display information by which flow rate of decontaminant neutralizer through said neutralizer conduit is measured, wherein one or more pumps, valves, sensors, and, alternatively or concurrently, gauges comprising the instant art are in communication with one or more data display or control units, whereby status or sensor results are displayed or alternately or concurrently, referenced for making adjustments to meet desired standards.

13. A conduit preparation module in, combination with a channel and a conduit in preparation;

said conduit preparation module so configured that said channel is placed in direct or indirect fluid-flow communication with the conduit-in-preparation, and in direct or, alternately or concurrently, indirect fluid-flow communication with a fluid source, such that fluid from said fluid source flows from said fluid source through the conduit preparation module and then flows into said conduit-in-preparation, said conduit preparation module comprising a decontaminant conduit placed in fluid-flow communication, directly, or, alternately or concurrently, indirectly, with the conduit-in-preparation, said decontaminant conduit also placed in fluid-flow communication, directly or alternately or concurrently, indirectly, with a decontaminant fluid pump, said decontaminant fluid pump is placed in communication directly, or alternately or concurrently, indirectly, with a liquid decontaminant source, said decontamination conduit also comprising a decontaminant conduit valve, wherein fluid flow rate through the decontaminant conduit is adjusted by adjusting the flow rate of the decontaminant pump, or alternatively or concurrently, by adjusting said decontaminant conduit valve, whereby, the liquid decontaminant is at least selectively injected into the conduit preparation module directly using the liquid the decontaminant pump to inject the decontaminant, wherein decontaminant, when injected, is combined with fluid flowing there through, and from which it can be borne to the conduit-in-preparation, whereupon into or through which the decontaminant can then flow, during which flow, the decontaminant comes in contact with an inner surface of the conduit-in-preparation, and said liquid decontaminant with the decontaminant pump is utilized at least in part from the liquid decontaminant source to pressure test at least the conduit-in-preparation; and also incorporating means of neutralizing injected decontaminant after it has been used, and before it is discharged for disposal, said means comprising a neutralizer source and a decontaminant neutralizer mixing and ejection device, wherein decontaminant neutralizer is cached in the neutralizer source, said neutralizer source being in communication with the decontaminant neutralizer mixing and ejection device whereby decontaminant and decontaminant neutralizing agent is mixed and ejected for disposal, wherein said communication is by means of a neutralizer conduit and comprises a neutralizer-pump whereby decontaminant neutralizer is urged form the neutralizer source through the neutralizer conduit to the decontaminant neutralizer mixing and ejection device, also comprising flow-rate controls for the neutralizer-pump whereby rate at which the pump transfers fluid is regulated, and a sensor and display that extracts and displays information by which flow rate of decontaminant neutralizer through said neutralizer conduit is measured, wherein one or more selected pumps and concurrently or alternatively, valves also comprise open or closed loop, remote or local control devices whereby they is adjusted from a local or remote location.

14. A conduit preparation module in, combination with a channel and a conduit in preparation;

said conduit preparation module so configured that said channel is placed in direct or indirect fluid-flow communication with the conduit-in-preparation, and in direct or, alternately or concurrently, indirect fluid-flow communication with a fluid source, such that fluid from said fluid source flows from said fluid source through the conduit preparation module and then flows into said conduit-in-preparation, said conduit preparation module comprising a decontaminant conduit placed in fluid-flow communication, directly, or, alternately or concurrently, indirectly, with the conduit-in-preparation, said decontaminant conduit also placed in fluid-flow communication, directly or alternately or concurrently, indirectly, with a decontaminant fluid pump, said decontaminant fluid pump is placed in communication directly, or alternately or concurrently, indirectly, with a liquid decontaminant source, said decontamination conduit also comprising a decontaminant conduit valve, wherein fluid flow rate through the decontaminant conduit is adjusted by adjusting the flow rate of the decontaminant pump, or alternatively or concurrently, by adjusting said decontaminant conduit valve, whereby, the liquid decontaminant is at least selectively injected into the conduit preparation module directly using the liquid the decontaminant pump to inject the decontaminant, wherein decontaminant, when injected, is combined with fluid flowing there through, and from which it can be borne to the conduit-in-preparation, whereupon into or through which the decontaminant can then flow, during which flow, the decontaminant comes in contact with an inner surface of the conduit-in-preparation, and said liquid decontaminant with the decontaminant pump is utilized at least in part from the liquid decontaminant source to pressure test at least the conduit-in-preparation; and also incorporating means of neutralizing injected decontaminant after it has been used, and before it is discharged for disposal, said means comprising a neutralizer source and a decontaminant neutralizer mixing and ejection device, wherein decontaminant neutralizer is cached in the neutralizer source, said neutralizer source being in communication with the decontaminant neutralizer mixing and ejection device whereby decontaminant and decontaminant neutralizing agent is mixed and ejected for disposal, wherein said communication is by means of a neutralizer conduit and comprises a neutralizer-pump whereby decontaminant neutralizer is urged form the neutralizer source through the neutralizer conduit to the decontaminant neutralizer mixing and ejection device, also comprising flow-rate controls for the neutralizer-pump whereby rate at which the pump transfers fluid is regulated, and a sensor and display that extracts and displays information by which flow rate of decontaminant neutralizer through said neutralizer conduit is measured, wherein one or more selected pumps and concurrently or alternatively, valves also comprise open or closed loop, remote or local control devices whereby they are adjusted from a local or remote location, also comprising a data processing device receiving and processing data and generating appropriate commands for adjustment of selected pumps and concurrently or alternatively, valves, to conform to relevant parameters without human intervention.

15. A conduit preparation module in, combination with a channel and a conduit in preparation;

said conduit preparation module so configured that said channel is placed in direct or indirect fluid-flow communication with the conduit-in-preparation, and in direct or, alternately or concurrently, indirect fluid-flow communication with a fluid source, such that fluid from said fluid source flows from said fluid source through the conduit preparation module and then flows into said conduit-in-preparation, said conduit preparation module comprising a decontaminant conduit placed in fluid-flow communication, directly, or, alternately or concurrently, indirectly, with the conduit-in-preparation, said decontaminant conduit also placed in fluid-flow communication, directly or alternately or concurrently, indirectly, with a decontaminant fluid pump, said decontaminant fluid pump is placed in communication directly, or alternately or concurrently, indirectly, with a liquid decontaminant source, said decontamination conduit also comprising a decontaminant conduit valve, wherein fluid flow rate through the decontaminant conduit is adjusted by adjusting the flow rate of the decontaminant pump, or alternatively or concurrently, by adjusting said decontaminant conduit valve, whereby, the liquid decontaminant is at least selectively injected into the conduit preparation module directly using the liquid the decontaminant pump to inject the decontaminant, wherein decontaminant, when injected, is combined with fluid flowing there through, and from which it can be borne to the conduit-in-preparation, whereupon into or through which the decontaminant can then flow, during which flow, the decontaminant comes in contact with an inner surface of the conduit-in-preparation, and said liquid decontaminant with the decontaminant pump is utilized at least in part from the liquid decontaminant source to pressure test at least the conduit-in-preparation; and also incorporating means of neutralizing injected decontaminant after it has been used, and before it is discharged for disposal, said means comprising a neutralizer source and a decontaminant neutralizer mixing and ejection device, wherein decontaminant neutralizer is cached in the neutralizer source, said neutralizer source being in communication with the decontaminant neutralizer mixing and ejection device whereby decontaminant and decontaminant neutralizing agent is mixed and ejected for disposal, wherein said communication is through a neutralizer conduit and comprises a neutralizer-pump whereby decontaminant neutralizer is urged from the neutralizer source through the neutralizer conduit to the decontaminant neutralizer mixing and ejection device, also comprising flow-rate controls for the neutralizer-pump whereby rate at which the pump transfers fluid is regulated and, a sensor and display that extracts and displays information by which flow rate of decontaminant neutralizer through said neutralizer conduit is measured, wherein one or more selected pumps and concurrently or alternatively, valves also comprise open or closed loop, remote or local control devices whereby they are adjusted from a local or remote location, open or closed loop, remote or local control devices a central control unit in communication with said open or closed loop, remote or local control devices, or alternately or concurrently, and wherein said central control unit is operated manually or alternately or concurrently, automatically.

* * * * *